United States Patent [19]

Pryor

[11] Patent Number: 4,537,583

[45] Date of Patent: Aug. 27, 1985

[54] METHOD AND APPARATUS FOR CONVEYING FILTER TOW

[75] Inventor: James W. Pryor, Winston-Salem, N.C.

[73] Assignee: R. J. Reynolds Tobacco Company, Winston-Salem, N.C.

[21] Appl. No.: 468,012

[22] Filed: Feb. 18, 1983

[51] Int. Cl.[3] ..... B31C 13/00

[52] U.S. Cl. ..... 493/42; 493/44; 493/48; 28/282

[58] Field of Search ..... 493/40, 42, 44, 46, 493/48, 49, 50; 28/282

[56] References Cited

U.S. PATENT DOCUMENTS

| | | | |
|---|---|---|---|
| 1,728,682 | 9/1929 | Kampf | 28/282 |
| 3,297,506 | 1/1967 | Pannill, Jr. et al. | 493/44 |
| 3,340,576 | 9/1967 | Pannill, Jr. et al. . | |
| 3,361,137 | 1/1968 | Watson | 493/44 |
| 3,411,942 | 11/1968 | Fritz et al. . | |
| 3,413,698 | 12/1968 | Fritz et al. . | |

FOREIGN PATENT DOCUMENTS

| | | | |
|---|---|---|---|
| 742866 | 5/1943 | Fed. Rep. of Germany | 28/282 |
| 1134139 | 4/1957 | France | 493/42 |
| 1137870 | 12/1968 | United Kingdom | 28/282 |

*Primary Examiner*—Daniel C. Crane
*Assistant Examiner*—David B. Jones
*Attorney, Agent, or Firm*—Herbert J. Bluhm

[57] ABSTRACT

Apparatus is disclosed for withdrawing a bloomed, continuous multifilament filter tow from a jet device and conveying the filter tow to filter rod-forming means in such a way that compaction or compression of the filter tow prior to its entry into the rod-forming means is minimized.

9 Claims, 5 Drawing Figures

METHOD AND APPARATUS FOR CONVEYING FILTER TOW

TECHNICAL FIELD

This invention relates to the processing of a continuous multifilament filter tow prior to forming the filter tow into filter rods suitable for use in the manufacture of filter cigarettes.

BACKGROUND ART

The manufacture of cigarette filters from a continuous, multifilament filter tow generally involves processing steps which include separation of the individual filaments (i.e., "opening up" of the tow), the application of plasticizer or other additives to the filter tow and the formation of a continuous filter rod from the treated filter tow. The uniformity and filtering characteristics of the resulting filter rod are largely determined by the effectiveness of these tow processing steps. Thus, there is a substantial amount of prior art which is directed to methods and apparatus for transforming filter tow into cigarette filters having predictable smoke filtration characteristics.

One of the presently used commercial processes for transforming a continuous, multifilament filter tow into a filter rod involves passing the tow through a jet device where the tow is subjected to a high velocity stream of gaseous fluid. The jet device serves to separate the individual filaments from each other and to create a bloomed, substantially round, rope-like appearance in the filter tow as it emerges from the jet device. The bloomed filter tow is then conveyed via delivery rolls to filter rod-forming means where the bloomed tow is compacted into an essentially round filter rod. A typical jet device and processing arrangement is disclosed in U.S. Pat. No. 3,297,506. A disadvantage of this prior art arrangement, however, is that the delivery rolls which convey the filter tow from the jet device to the rod-forming means (i.e., the cigaretting machine) compresses the tow between the opposing surfaces of the delivery rolls thereby causing the tow to assume a flat band configuration. In other words the delivery rolls tend to destroy the advantageous configuration of the bloomed filter tow as it emerges from the jet device. This problem is apparently appreciated by the inventors named in U.S. Pat. No. 3,297,506 in that the use of a stuffer jet at the entrance to the cigaretting machine is disclosed. The stuffer jet restores to some extent the substantially round, rope-like configuration of the filter tow existing at the time it emerges from the blooming jet device. The use of a stuffer jet, however, adds to the processing costs because a pressurized supply of gaseous fluid must be provided for operating the jet. The processing arrangement shown in the above-identified patent as practiced commercially has not, in fact, employed a stuffer jet but, rather, a condensing horn positioned at the entrance to the cigaretting machine.

The prior art appreciates the desirability of forming a filter rod from tow that has been shaped into a rope-like configuration by an air jet rather than by gathering and compacting from a thin flat band of tow. Thus, column 6 (lines 7–18) of U.S. Pat. No. 3,411,942 teaches that less liquid additive (e.g., plasticizer) will be coated on the delivery rolls and less folding and crumpling of the tow will be realized if the tow is conveyed to the filter rod-forming means in a cylindrical shape. In spite of the recognition that formation of a filter rod from a flat band of tow is less desirable than formation from a rope-like configuration, this patent fails to teach an alternative to the delivery roll arrangement which compresses the filter tow between the opposing surfaces of the rolls.

BRIEF SUMMARY OF THE INVENTION

This invention provides an improved method and apparatus for conveying a continuous multifilament filter tow in the processing of such tow for the manufacture of filter rods therefrom.

It is a principal object of this invention to provide a method and apparatus for conveying a continuous multifilament filter tow by passing the tow between rotating, cooperating rolls which are designed to minimize compression of the tow.

It is a further object of this invention to provide a method and apparatus for conveying a continuous multifilament filter tow previously formed into a substantially round, rope-like configuration so that the rope-like configuration is essentially retained during conveyance thereof.

Other objects and advantages of the invention will be apparent from the detailed description which follows.

DETAILED DESCRIPTION OF THE INVENTION

Figure 3:
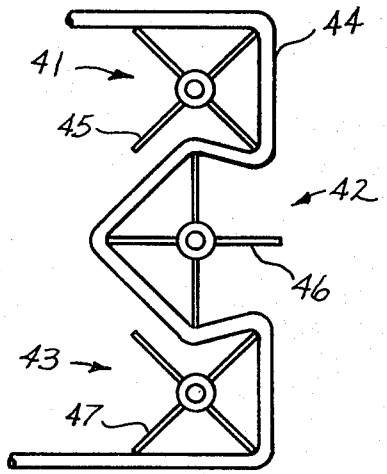
FIG. 3 is a side elevational view of another embodiment of the present invention showing three cooperating rolls, for conveying filter tow.

This invention provides an improved method and apparatus for conveying filter tow in the processing of a continuous multifilament filter tow to form a continuous filter rod therefrom. Specifically, the invention involves means for conveying the filter tow in such a way that the tow is not compressed or compacted between tow contacting surfaces that are directly opposite each other. This result is achieved by directing filter tow between cooperating rolls rotating in opposite direction with each roll comprising a shaft provided with a plurality of tow-contacting members projecting radially outwardly from the longitudinal axis of the shaft and spaced circumferentially around the periphery of the shaft, the cooperating rolls being maintained in parallel, aligned juxtaposition that is close enough to engage and advance the filter tow without significantly compressing the filter tow between directly opposed tow-contacting members.

The tow-contacting members on the rotatable, cooperating rolls preferably take the form of discrete structures projecting radially outwardly from the longitudinal axis of the supporting shaft much like the spokes of a wheel. The tow-contacting members may be constructed of various materials and with different designs. For example, metals, rubber, plastics and wood are suitable materials and they may be shaped into flat panels or vanes with at least a portion of one edge of the panels or vanes being adapted for contacting the tow. Alternatively, the tow-contacting members may comprise frames constructed of the desired material. In either case it is preferred that each tow-contacting member be provided with an indentation or recessed area associated with the edge making contact with the filter tow so that the tow is confined to the recessed area as it passes around each cooperating roll. The indentations also serve to prevent or minimize compaction of the filter tow when the tow-contacting members on the cooperating rolls move into a directly opposed abutting position.

Depending on the design of the tow-contacting member and the material from which it is constructed, it may be desirable to position the cooperating rolls so that the tow-contacting members on one roll will intermesh with the tow-contacting members on the cooperating roll. This is particularly true when the tow-contacting members are provided with recesses which effectively position the path of the filter tow radially inwardly toward the shafts supporting the tow-contacting members. Thus, the cooperating rolls may have to be moved closer to each other to compensate for the recesses or tow-engaging indentations in the tow-contacting members. The need for intermeshing tow-contacting members is reduced or eliminated as the coefficient of friction associated with the tow-contacting members increases.

When the tow-contacting members on the cooperating rolls intermesh to any degree, it is desirable that a proper fixed registration between the cooperating rolls be maintained so that possible contact between the tow-contacting members on the two rolls and interference with uniform rotation of the rolls is avoided. It is preferred, therefore, that gear means be provided for maintaining proper registration of the cooperating rolls. Operation without such gear means is possible, however, because the filter tow passing between the cooperating rolls causes rotation of the non-driven roll in registration with the driven roll, particularly when the tow-contacting members are constructed of resilient materials and/or possess a high coefficient of friction. Maintaining the cooperating rolls in fixed registration is also unnecessary when the cooperating rolls do not intermesh and the tow-contacting members are provided with indentations or recessed areas of sufficient dimensions for engaging the tow and preventing significant compression of the tow even when the cooperating tow-contacting members come into directly opposed abutting contact.

To achieve satisfactory operation each cooperating roll should be provided with at least four tow-contacting members. The maximum number of tow-contacting members is not critical so long as sufficient clearance exists between the tow-contacting members on the cooperating rolls when the rolls are positioned in an intermeshing relationship. Generally, the number of tow-contacting members employed should be sufficient to provide the frictional resistance neccessary to withdraw the tow from the jet device without appreciable slippage occurring between the filter tow and the tow-contacting members attached to the rotating rolls. Thus, the materials of construction and coefficient of friction of the tow-contacting members will also influence the number of tow-contacting members required. It is preferred that the filter tow pass around each of the cooperating rolls as well as between them so that a substantial proportion of the tow-contacting members will make contact with the filter tow simultaneously. The filter tow should, therefore, follow a substantially semicircumferential path around each cooperating roll and simultaneously contact at least one half of the tow-contacting members attached to each roll. The portions of the tow-contacting members making contact with the filter tow should, of course, be free of sharp edges or burrs that could damage the advancing tow.

For a better understanding of the present invention, reference will now be made to the accompanying drawings.

Figure 1:
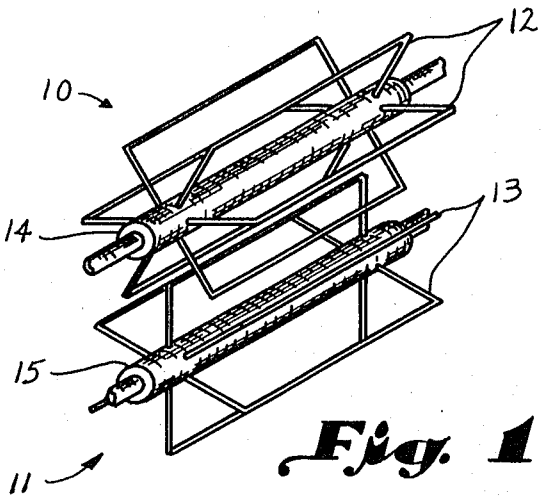
FIG. 1 is a perspective view of two cooperating rolls each of which is provided with six discrete tow-contacting members.

FIG. 1 shows two cooperating rolls 10 and 11 for conveying filter tow, each roll being provided with six tow-contacting members 12 and 13. Tow-contacting members 12 and 13 are constructed of suitable gauge wire, preferably 1 millimeter diameter or greater. Tow-contacting members 12 and 13 are securely attached to shafts 14 and 15, respectively, so that the spacing between adjacent tow-contacting members on each roll remains relatively constant. Rolls 10 and 11 are rotated in opposite directions and maintained in proper registration by means (not shown) well known in the art.

Figure 2:
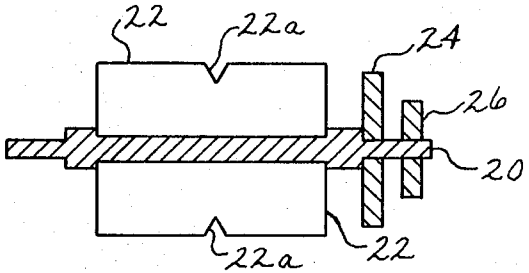
FIG. 2 is a cross-sectional view of a cooperating roll showing notched areas or indentations in the tow-contacting members for engaging the filter tow.

Shown in FIG. 2 is a cross-section of a cooperating roll in accordance with another embodiment of the present invention wherein the section is taken through the longitudinal axis of shaft 20 and the plane of two of the attached tow-contacting members 22. The tow-contacting members 22 are solid panels or rigid sheets of suitable material which are provided with notched areas or recesses **22*a* for engaging the filter tow and restricting its lateral movement as it traverses the roll. Gear 24 mounted on shaft 20 is designed to engage a similar gear associated with a second cooperating roll to insure that rotation of the cooperating rolls is kept in proper fixed registration. Also mounted on shaft 20 is drive gear 26 which engages means (not shown) for rotating gear 26** and the cooperating rolls associated therewith.

An alternative embodiment of this invention is shown in FIG. 3 wherein cooperating rolls 41, 42 and 43 are shown for conveying filter tow 44. Each of rolls 41, 42 and 43 are provided with four tow-contacting members 45, 46 and 47 respectively. The rotation of rolls 41, 42 and 43 is maintained in proper registration by gear means (not shown) similar to those depicted in FIG. 2.

Figure 4:
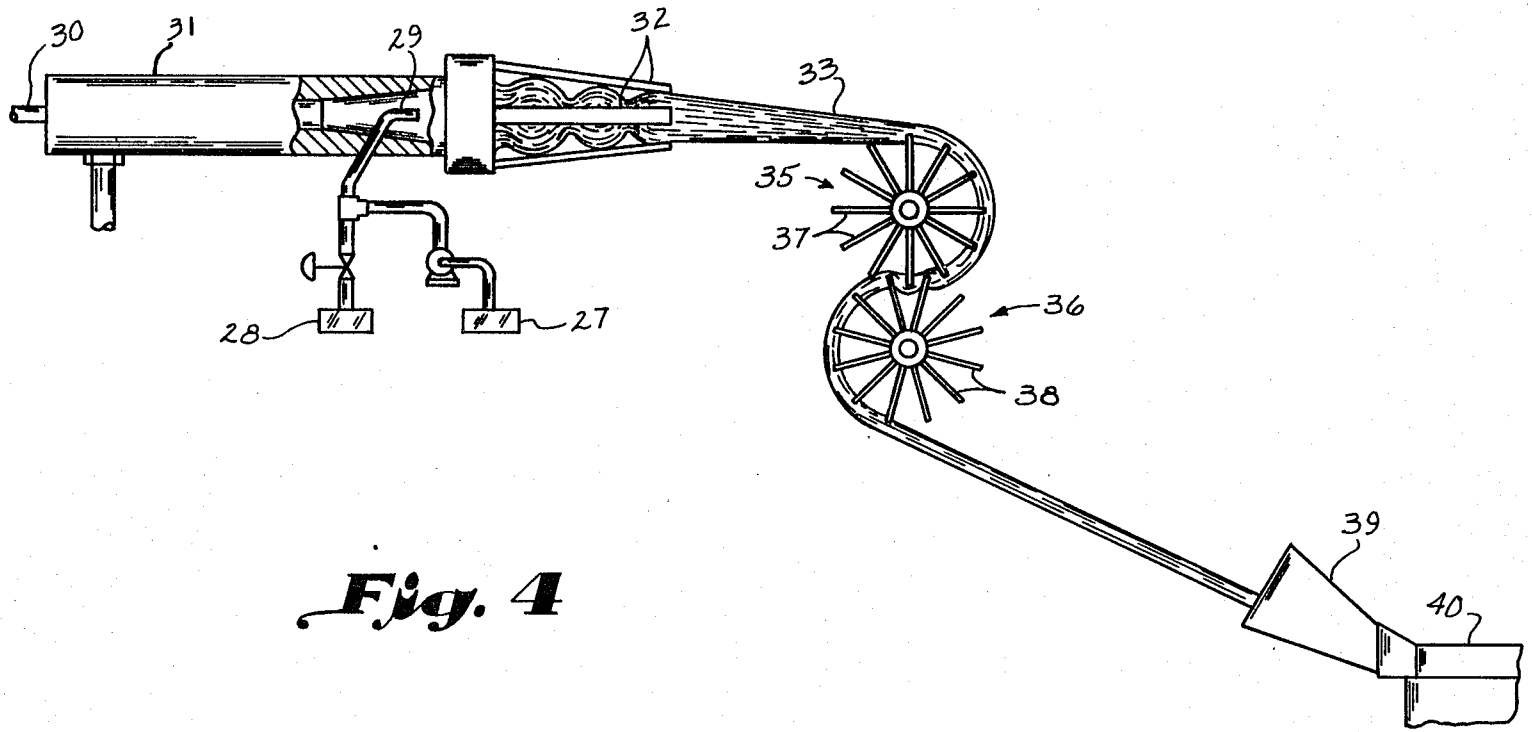
FIG. 4 is a side elevational view of a preferred tow-processing arrangement which employs two cooperating rolls having tow-contacting members provided with indentations or recessed areas for engaging the filter tow.

A preferred tow-processing arrangement in accordance with this invention is depicted by FIG. 4. A continuous, multifilament filter tow 30 that has been preliminarily processed is introduced into jet device 31 where the tow is subjected to a high velocity stream of gaseous fluid. The jet device 31 is provided with nozzle means 29 through which additive from supply tank 27 and atomizing gas from gas supply tank 28 may be introduced into the jet device if desired. The bloomed filter tow 33 which emerges from the jet device is temporarily confined by flexible finger-like projections 32 attached to the exit end of jet device 31. The bloomed filter tow 33 is withdrawn from the jet device by the action of rotating, cooperating rolls 35 and 36 which are shown in a perspective view in FIG. 5. Roll 35 is provided with twelve tow-contacting members 37 each of which possesses a recessed area **37*a* (see FIG. 5) for engaging tow 33. Roll 36 is similarly provided with tow-contacting members 38 (and recesses 38*a*) which are maintained in intermeshing relationship with tow-contacting members 37 by spur gears (not shown). The tow advances around and between rolls 35 and 36 and proceeds to the inlet condensing horn 39 of rod-forming means 40. Rolls 35 and 36** are rotated by coventional means (not shown), the speed of rotation being controlled with respect to the speed of the over-all tow-processing operation.

The following examples will further illustrate the advantages of this invention.

EXAMPLE 1

A continuous multifilament filter tow is subjected to conventional treatment preparatory to forming a continuous filter rod therefrom. This treatment includes a tow-processing arrangement similar to that depicted in FIG. 4 wherein the filter tow is transformed into a rounded, rope-like configuration by a jet device. The rope-like bundle of filter tow is withdrawn from the jet device by two cooperating, specially designed delivery rolls which are shown in more detail in FIG. 5. Each of the cooperating rolls comprises 12 tow-contacting members projecting radially outwardly from the supporting shaft. Each tow-contacting member is provided with an indentation or recessed area for engaging the filter tow and restricting its lateral movement as it traverses the delivery rolls. The indentations formed in each of the tow-contacting members have an elliptic arch shape and are in substantial alignment. The length of the indented portion of the tow-contacting member is approximately 50 millimeters and the maximum depth of each indentation is 7 millimeters. The relative parallel positions of the delivery rolls are such that each tow-contacting member on one roll projects about 7 millimeters into the space between two adjacent tow-contacting members on the other delivery roll. Meshing gears affixed to each supporting shaft of the cooperating delivery rolls maintain the delivery rolls in proper registration. The supporting shaft of one of the delivery rolls is provided with drive means interconnected with the filter tow transport apparatus feeding the tow into the jet device to assure a constant relationship between the tow speed upstream and downstream of the jet device.

After the rope-like, bloomed filter tow traverses the cooperating delivery rolls, it is directed into the inlet of a KDF-II filter rod maker (manufactured by Hauni-Werke Korber & Co. of Hamburg, West Germany) which forms the filter tow into a continuous filter rod at a speed of 400 meters per minute. The rounded, rope-like configuration of the filter tow exiting from the jet device is substantially maintained during its traverse of the cooperating delivery rolls and greatly reduced folding and crumpling of the individual filaments of the filter tow occur as it enters the inlet of the filter rod maker. The resulting filter rod, as a result, has improved uniformity with respect to filtration and pressure drop characteristics.

EXAMPLE 2

A filter tow processing arrangement similar to that shown in FIG. 4 and described in Example 1 is used for treating filter tow preparatory to forming the tow into a continuous filter rod. This arrangement includes a blooming jet device provided with nozzle means concentrically positioned within the jet device to apply a solution of flavoring agents in triacetin to the filaments in the central portion of the filter tow bundle. In order to provide a visual indication of the distribution pattern that results from such an application of flavoring agents, a red dye is also included in the triacetin solution. The nozzle means for applying the triacetin solution comprises 6.5-mm. diameter stainless steel tubing that is sealed off by a metal plug that is inserted into the end of the tubing that is concentrically positioned within the jet device. Adjacent to the metal plug sealing off the end of the tubing are 24 0.8-mm. diameter holes in the tubing wall arranged as two circumferentially and uniformly spaced rows. The 6.5-mm. diameter stainless steel tubing leading to the nozzle means is provided with means for injecting via an 0.18-mm. inside diameter capillary tube controlled amounts of the triacetin solution. Means are also provided for introducing pressurized air into the 6.5-mm. diameter tubing so that the triacetin solution injected into the tubing is carried by the pressurized air to the nozzle means where it is forced through the circumferentially arranged holes in a radial, aerated spray pattern.

Figure 5:
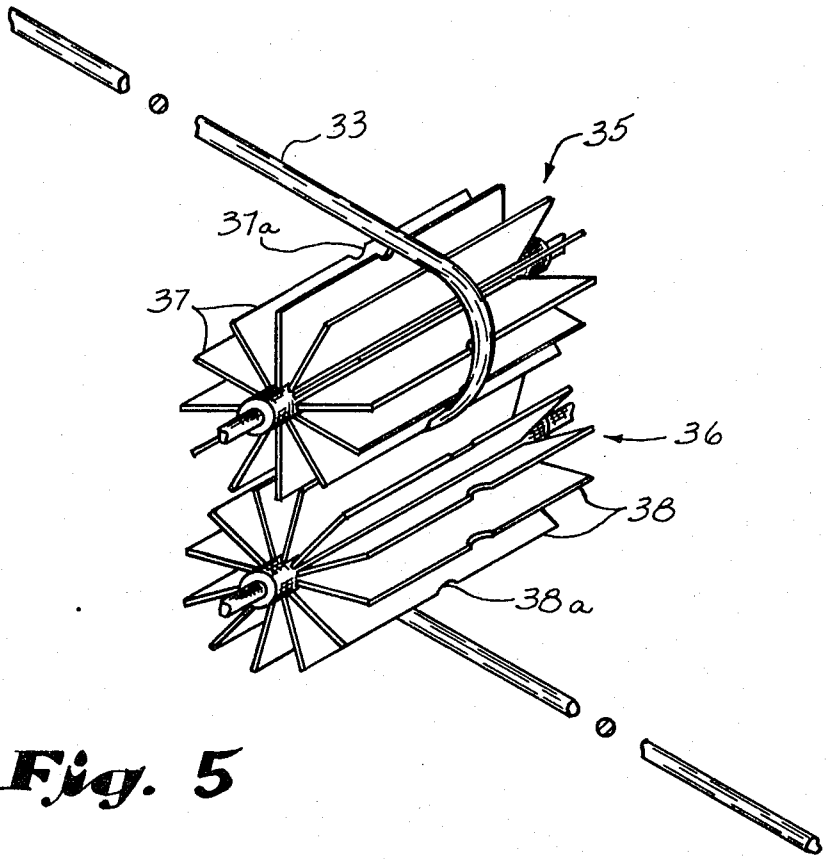
FIG. 5 is a perspective view of the cooperating rolls shown in the FIG. 4 tow-processing arrangement.

As shown in FIGS. 4 and 5 and described in detail in Example 1, specially designed delivery rolls are used to withdraw the treated filter tow from the jet device and to convey the tow to the inlet of the KDF-II filter rod maker. In order to demonstrate the effectiveness of the specially designed delivery rolls, the filter tow is processed using this same processing arrangement except that the specially designed delivery rolls are replaced by two conventional solid steel rolls having smooth surfaces. When the specially designed delivery rolls are used, the rope-like configuration of the filter tow withdrawn from the jet device is retained as the tow traverses the delivery rolls and the distribution of the triacetin solution in the subsequently formed filter rod is concentrated largely along the longitudinal axis of the filter rod. Use of the solid steel delivery rolls, on the other hand, compresses the filter tow into a flat band configuration and the distribution of the triacetin solution is concentrated largely on the periphery of the subsequently formed filter rod and to one side of the filter as viewed in cross section. Although the filter rods produced with the different delivery roll designs have comparable filtration and pressure drop characteristics, the flavor effect associated with filters formed while employing the specially designed delivery rolls is much more pronounced than with filters formed while the solid steel delivery rolls are employed. The increased flavor effect obtained with the specially designed rolls is attributed to the distribution of the triacetin/-flavoring solution which coincides largely with the longitudinal axis of the formed filter rod and the principal path of smoke passing through the filter.

What is claimed is:

1. Apparatus for withdrawing a bloomed, continuous multifilament filter tow from a jet device and conveying the bloomed filter tow to filter rod-forming means, said apparatus including at least two rotatable, cooperating rolls with each roll comprising a shaft provided with a plurality of tow-contacting members projecting radially outwardly from the longitudinal axis of the shaft and spaced circumferentially around the periphery of the shaft with the tow-contacting members of at least one of the rolls being provided with recessed areas for engaging the filter tow, means for rotating at least one of the rolls and means for maintaining the cooperating rolls in parallel, aligned juxtaposition that is close enough to engage and advance the filter tow introduced between the rolls without significantly compressing the filter tow between directly opposed tow-contacting members.

2. The apparatus of claim 1 wherein each roll is provided with at least four tow-contacting members.

3. The apparatus of claim 2 wherein the juxtaposition of the rolls is such that the tow-contacting members of one roll intermesh with the tow-contacting members of the cooperating roll.

4. The apparatus of claims 1, 2 or 3 which includes means for maintaining the cooperating rolls in fixed registration during rotation thereof.

5. The apparatus of claim 1, 2 or 3 wherein the tow-contacting members are constructed of resilient materials.

6. In a process for converting a continuous, multifilament filter tow into a filter rod wherein the filter tow is bloomed by a high velocity stream of gaseous fluid in a jet device having a substantially circular cross-sectional configuration and the resulting cylindrically-shaped, bloomed filter tow is subsequently introduced into a rod-forming device for compacting and shaping the tow into a filter rod, the improvement which comprises (a) withdrawing the cylindrically-shaped, bloomed filter tow from the jet device by at least two rotating, cooperating rolls, each roll comprising a shaft provided with a plurality of discrete tow-contacting members projecting radially outwardly from the longitudinal axis of the shaft and adapted to engage and to advance the filter tow between the rolls without significantly compressing the filter tow between directly opposed tow-contacting members, (b) passing the bloomed filter tow around each of said cooperating rolls to form a substantially semicircumferential path around each cooperating roll and (c) directing the filter tow to the rod-forming means while substantially preserving the cylindrically-shaped, bloomed configuration of the filter tow.

7. The improvement of claim 6 which includes the step of maintaining the rotating, cooperating rolls in juxtaposition and fixed registration so that the tow-contacting member of one roll intermesh with the tow-contacting members of the cooperating roll.

8. In a process for converting a continuous, multifilament filter tow into a filter rod wherein the filter tow is bloomed by a high velocity stream of gaseous fluid in a jet device having a substantially circular cross-sectional configuration and the resulting cylindrically-shaped, bloomed filter tow is subsequently introdued into a rod-forming device for compacting and shaping the tow into a filter rod, the improvement which comprises (a) withdrawing the cylindrically-shaped, bloomed filter tow from the jet device by at least two rotating, cooperating rolls, each roll comprising support means for a plurality of discrete tow-contacting members projecting radially outwardly from the longitudinal axis of the roll and adapted to engage and to advance the filter tow between the rolls without significantly compressing the filter tow between directly opposed tow-contacting members, the tow-contacting members of at least one of the rolls being provided with recessed areas for engaging the filter tow during its traverse of the cooperating rolls, (b) passing the bloomed filter tow around each of said cooperating rolls to form a substantially semicircumferential path around each cooperating roll and (c) directing the filter tow to the rod-forming means while substantially preserving the cylindrically-shaped, bloomed configuration of the filter tow.

9. The improvement of claim 8 which includes the step of maintaining the rotating, cooperating rolls in juxtaposition and fixed registration so that the tow-contacting members of one roll intermesh with the tow-contacting members of the cooperating roll.

* * * * *